US005237930A

United States Patent [19]

Bélanger et al.

[11] Patent Number: 5,237,930

[45] Date of Patent: Aug. 24, 1993

[54] FRANGIBLE PRACTICE AMMUNITION

[75] Inventors: Germain Bélanger, St. Germain-de-Grantham; Marc Potvin, Val Bélair, both of Canada

[73] Assignee: SNC Industrial Technologies, Inc., Le Gardeur, Canada

[21] Appl. No.: 831,263

[22] Filed: Feb. 7, 1992

[51] Int. Cl.[5] ..... F42B 8/14

[52] U.S. Cl. ..... 102/529; 102/506; 102/511

[58] Field of Search ..... 102/395, 498, 501, 506, 102/529, 511, 517, 502

[56] References Cited

U.S. PATENT DOCUMENTS

| | | | |
|---|---|---|---|
| 2,995,090 | 8/1961 | Daubenspeck | 102/529 |
| 3,123,003 | 3/1964 | Lange, Jr. et al. | 102/91 |
| 3,785,293 | 1/1974 | Barr et al. | 102/92.7 |
| 4,466,330 | 8/1984 | Juretzek et al. | 102/529 |
| 4,603,637 | 8/1986 | Snide et al. | 102/529 |

FOREIGN PATENT DOCUMENTS

| | | |
|---|---|---|
| 1264124 | 1/1990 | Canada . |
| 96617 | 12/1983 | European Pat. Off. . |
| 2092274 | 8/1982 | United Kingdom . |
| 88/09476 | 12/1988 | World Int. Prop. O. . |

*Primary Examiner*—Harold J. Tudor
*Attorney, Agent, or Firm*—Longacre & White

[57] ABSTRACT

The disclosure herein describes a frangible practice ammunition comprising a compacted mixture of fine copper powder and of a thermoplastic resin selected from the group consisting of nylon 11 and nylon 12. The mixture which is compacted by injection molding, has at least 90% by weight of copper and a specific gravity of 5.7.

11 Claims, 3 Drawing Sheets

Figure Ia

| % Co | Specific gravity |
|---|---|
| 0.75 | 3.30 |
| 0.76 | 3.38 |
| 0.77 | 3.47 |
| 0.78 | 3.56 |
| 0.79 | 3.66 |
| 0.80 | 3.77 |
| 0.81 | 3.88 |
| 0.82 | 4.00 |
| 0.83 | 4.13 |
| 0.84 | 4.26 |
| 0.85 | 4.40 |
| 0.86 | 4.56 |
| 0.87 | 4.72 |
| 0.88 | 4.90 |
| 0.89 | 5.09 |
| 0.90 | 5.29 |
| 0.91 | 5.52 |
| 0.92 | 5.76 |
| 0.93 | 6.02 |
| 0.94 | 6.31 |
| 0.95 | 6.63 |
| 0.96 | 6.99 |
| 0.97 | 7.38 |
| 0.98 | 7.82 |
| 0.99 | 8.32 |

Figure Ib

| | % Co | S.G. |
|---|---|---|
| 88% Co | 0.88 | 4.90 |
| 93% Co | 0.93 | 6.02 |
| % Increase | 5.38% | 18.60% |

Figure Ic

FRANGIBLE PRACTICE AMMUNITION

FIELD OF THE INVENTION

The present invention relates to a frangible practice ammunition or bullet for use in shooting galleries and the like.

BACKGROUND OF THE INVENTION

Lead gallery bullets are well known; they are characterized by the use of powders of lead consolidated into a bullet having sufficient strength for use and intended to be disrupted into small fragments on impact with a gallery target.

The costs associated with the training of users of such ammunitions are extremely high. First, in a shooting gallery, an expensive device, called "bullet trap", is required to stop the projectile to prevent fragments from injuring shooters. Furthermore, the walls of the shooting galleries must be covered with "ballistic rubber" in order to stop occasional fragments of the projectile.

There is also lead contamination which bears a heavy burden in the cost associated with training with standard ammunitions. During a shooting session, there is an emission of lead dust into the atmosphere. Also, the accumulation of projectiles in shooting galleries causes an environmental problem. Many shooting galleries have been closed recently due to the high level of lead in these installations.

The problem is replacing lead for the purpose of a gallery shooting round is to find a material sufficiently heavy that the automatic weapons will be able to cycle and the shooter will see few differences. Costly or toxic heavy metals should be avoided while a cheap production process is required to keep production costs low.

The main criteria for the ability of a round to cycle autoloader weapons is the amount of energy that it delivers to the cycling mechanism. For some type of weapons, this energy is delivered by the expanding gases pushing back the cartridge case. This type may be found with the 9 mm Browning Hi-Power pistol for example. For some others, high pressure gases are connected through a port pressure inside the barrel. The high pressured gases are then the source of energy for the cycling mechanism. This type is found in most 5.56 NATO nominated weapons, like the Colt M16.

Weapons and propellant powders are designed to work with a projectile of a certain mass that gives a typical pressure-vs-time curve. Using a lighter projectile will cause problems, the main one being too low an energy transfer to give the feeding mechanism the needed momentum to cycle, in certain type of weapons.

In order to replace lead in a projectile, the selected material should have a minimum specific gravity so that the resulting projectile mass is compatible with commercially available propellants for that calibre. This is important since it would not be economically viable to develop a lead-free round where a special propellant or other component would need to be developed.

It has been found that, with 5.56 mm autoloader weapons, the minimum specific gravity for a lead replacement material that would allow reliable cycling of most of these weapons would be 5.7. This specific gravity makes it possible to reach the same port pressure as with standard rounds, using the same propellants, but with a higher charge.

Training bullets including plastics material, either encapsulating or filled with metal powders, have been proposed to meet this problem.

European patent number 0,096,617, issued to Société Française de Munitions, describes a training bullet having a mixture of nylon, a powder of a ductile metal and a solid lubricant. This patent describes practice ammunitions wherein the specific gravity of the compound is between 3 and 5.

International patent application PCT 88-09476 describes a bullet comprising a matrix of plastics material having a water absorption factor similar to or greater than that of nylon 66 containing a filler material effective to raise the specific gravity of the bullet from 3 to 7. However, when copper is used, its content by weight is limited to 88%; whenever a higher percentage of metal powder is desired, copper must be mixed with another metal filler, such as tungsten (46.5% by weight).

OBJECTS AND STATEMENT OF THE INVENTION

It is an object of the present invention to provide a lead-free low cost replacement material for presently used frangible practice ammunitions. This has been achieved by using a compacted mixture of fine copper powder and of a thermoplastic resin.

Lead having a specific gravity of 11.3, it is evident that the specific gravity cannot be matched with equivalent metals available at an affordable cost (except gold, silver, mercury). The expensive metals (bismuth, nickel and tungsten) which all have advantages and disadvantages are possible. However, the choice of copper is the most economic approach to generate a replacement material to lead with added value, such as less toxicity or polluant.

It has been found that metals lighter than copper are not suitable since they are too light to reach the above-mentioned required specific gravity of 5.7 while metals heavier than copper are considered either as having high toxicity or being simply too expensive for the task.

To meet the needed minimum specific gravity of 5.7, it has been found that the proportion of copper in the mixture ought to be over 90%, preferably in the neighborhood 92 to 93% by weight.

To arrive at a compacted mixture which would contain about 93% by weight of fine copper powder and which would have a specific gravity of 5.7 for ammunition applications, it has also been found that a thermoplastic molding resin which will enable to obtain these characteristics is nylon 11, or nylon 12.

A compacted mixture of copper and nylon wherein copper is at least 90% by weight can best be achieved by injection molding.

One characteristic of a lead-free training round is that it breaks up into small particles when hitting a hard surface, like a steel plate. Each of these particles is then too light to carry enough energy to be considered as a dangerous projectile. With the 5.56 mm, if the projectile hits an armoured steel plate with an incidence angle of 90° and a velocity of 2,000 feet per second, particles that should splash back will not perforate a sheet of newsprint grade of paper placed one meter from the steel plate. On the other hand, such projectile should be sufficiently impact resistant to stand the high accelerations that occur on firing, plus the deformations that result from weapon rifling.

In addition to the above requirement, a nylon-copper compound as a lead replacement material should meet the following mechanical properties. The Izod Impact should be between 120 J/m and 140 J/m and the percentage of elongation before breaking should be at least 1.7%. Should the Izod impact be too low, the projectile will break up on firing. If it is too high, the minimum angle of incidence at which the projectile will break up and not ricochet on hitting a target will be too large. If the percentage of elongation before breaking is too low, the projectile will break up when deformed by the rifling of the weapon.

Again, in order to meet these mechanical properties using only copper as a filler, it has been found that its content, by weight, should preferably remain between 92.5% and 93.5%. Sample projectiles made at 95% of copper by weight have been found to give poor accuracy in 9 mm because of small particles detaching from the projectile, unstabilizing it; with 5.56 mm, the projectile will be completely broken when leaving the barrel. 95% copper could be used with 9 mm if the velocity is lowered to a point it can resist the firing stresses, but then cycling of the weapons becomes erratic because of lack of energy.

It has been found that, in order to have good accuracy, the projectile diameter should be oversized by 0.001 inch to 0.002 inch, compared to a standard projectile. This larger diameter is needed in order to make the projectile to shape completely into the grooves of the barrel. If it is not so shaped, there results an underspined projectile which is not stable.

Dimensional control must therefore be very strict for the projectile diameter. Maximum allowable variation is set to ±0.001 inch. Higher diameter will result in breaking projectiles on 5.56 mm, while lower diameter will lead to poor accuracy.

Another reason for a strict control of projectile diameter is the bullet pull effort. Projectiles made with the materials of the present invention are very strong longitudinally but could be weak radially. The standard method of crimping the projectile with the case mouth is not recommended since it results in a stress concentration at the point where the projectile is crimped. A tendency for projectiles crimped in such a way is to break in two at the exact crimping point. To avoid this, the inventors have developed, for a 5.56 mm round, a new cartridge case with a ball size smaller by 0.003 inch when compared to a standard NATO 5.56 mm case. The interference fit resulting from pushing the bullet into that smaller mouth is enough to give a stable 40 pounds bullet pull effort without any stress concentration that would make the projectile weak at any point.

The effect of humidity on projectile diameter is a concern since nylon is used as a matrix for the compound. However, the diameter variation recorded when conditioning projectiles between 0% and 100% relative humidity is neglectable with that high level of copper filler. On 9 mm for example, projectile diameter changed by less than 0.0002 inch between these two extreme conditions.

Another important dimensional criteria is the volume of the projectile which should be optimized in order to obtain the heaviest projectile possible. The inventors have worked with the ogive and the overall length of the projectile in order to push the weight of the 5.56 mm projectile up to 36 grains. The gyroscopic stability factor of this projectile is 1.25. Trying to get a better gyroscopic stability factor means compromising on weight. With this stability factor and a weight of 36 grains, an optimal design has been reached.

On 9 mm which is inherently more stable than 5.56 mm (with a gyroscopic stability factor higher than 3), the limitation in weight is governed by the limitation in length for the projectile. With that calibre, increasing the length of the projectile will result in less room for the propellant in the case. A fine balance should then be reached between the projectile length and the propellant charge and bulk density. With the present invention, a projectile 0.675 inch long has been found to be adequately satisfactory for a 9 mm calibre. A longer projectile results in a lower charge of propellant which, in returns, leads to a low energy round giving erratic cycling with some pistols. Shorter projectiles would also mean lighter projectiles that would give too different a pressure-vs-time curve and cycling problems will arise with longer barrelled weapons, like the Heckler & Koch MP-5. Hence, with the 9 mm calibre, the inventors have been able to push the weight up to 85 grains.

IN THE DRAWINGS

FIGS. 1*a*, 1*b* and 1*c* are graphs and tables illustrating the relationship between copper and the specific gravity; and FIGS. 2 and 3 are graphs illustrating the relationship of copper content to the flexural modulus and Izod impact.

DESCRIPTION OF PREFERRED EMBODIMENTS

Figure 1:
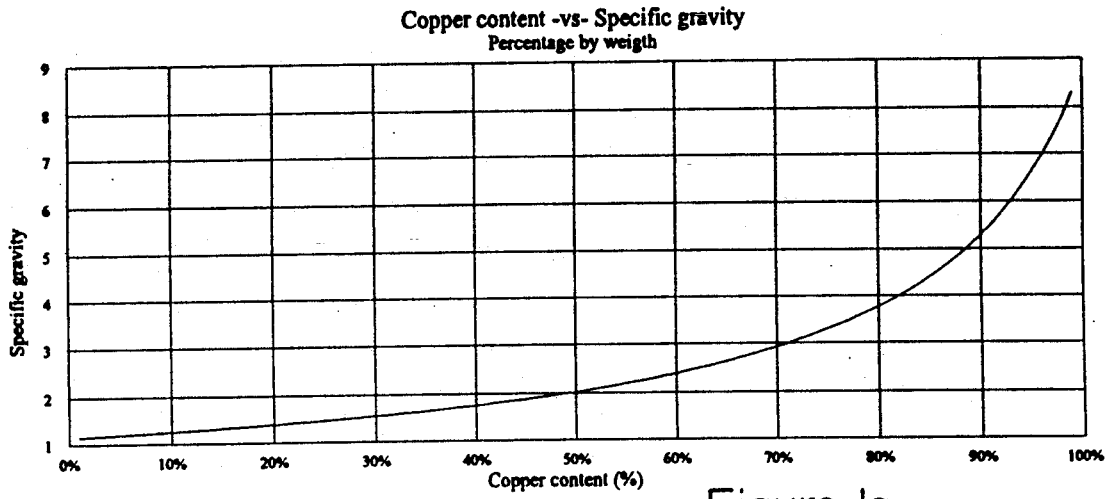

From the annexed FIGS. 1*a*, 1*b* and 1*c*, a sharp increase in specific gravity as the copper content increases may be seen. This is a typical behaviour when increasing the filler content in a metal polymer composite. Up to 60%, the specific gravity increase is close to linear; then, it starts increasing exponentially. For example, between 88% and 93% of copper loading (a 5.4% increase), a 18.6% specific gravity increase is obtained.

In order to get the specific gravity up to 5.7, it is essential to select the right particle geometry for the copper and the polymer allowing a minimum fluidity during injection molding and to use a unique particle size distribution of the copper and resin matrix.

Figure 2:
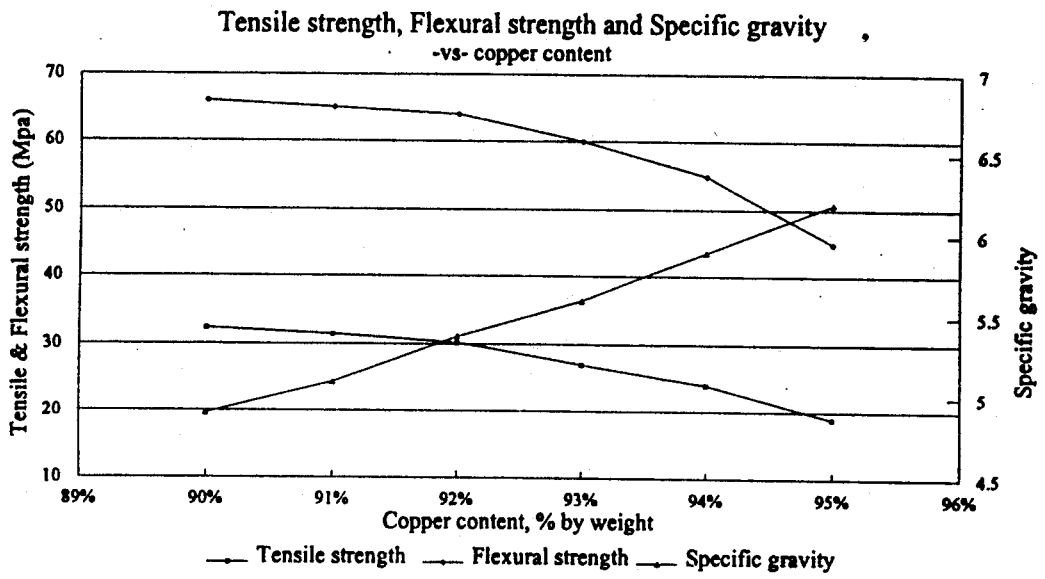
Figure 3:
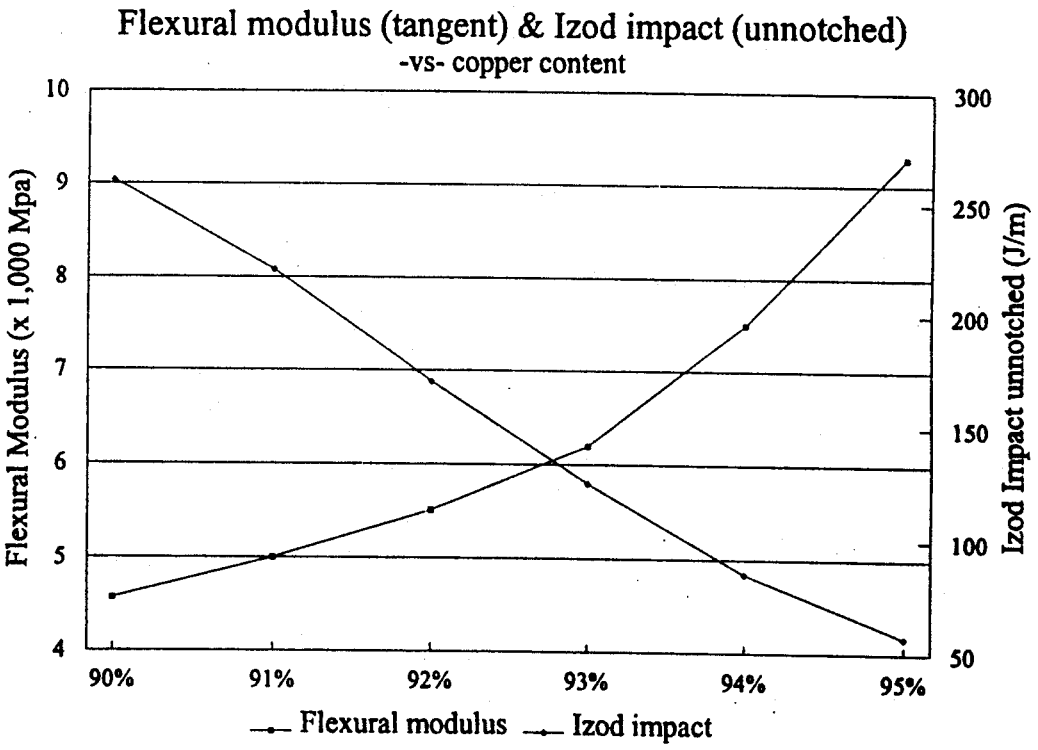
Figure 4:
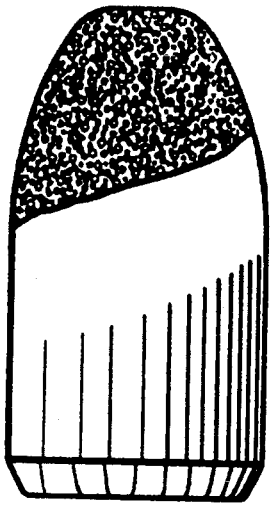
FIG. 4 is a partial sectional view illustrating the appearance of 9 mm caliber frangible practice ammunition according to the present invention.
Figure 5:
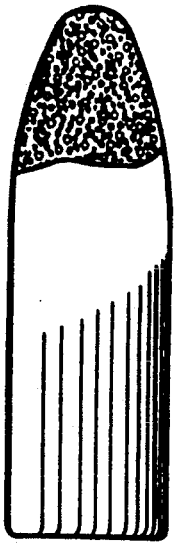
FIG. 5 is a partial sectional view illustrating the appearance of 5.56 mm caliber frangible practice ammunition according to the present invention.

FIGS. 2 and 3 show a sharp decrease in elongation and Izod impact as the copper content increases. This also emphasises the need for a thoroughly controlled compounding process.

Compounding up to a 88% copper content by weight can be made by standard processes. Higher than 90%, a special technique is required.

Injection molding of mixtures of fine metal powders and plastic resins, or binders, combines the strength and durability of metal with the design versatility of plastic injection molding. It is finding a place in metal parts with intricate geometrics that would cost many times more to produce by machining, die casting, etc.

The high requirement of dimensional tolerances after molding prohibits the use of cheap and low grade thermoplastic resins, such as polyethylene, polypropylene and others. The low shrink factor and the available powder form grade are the two major points which favor the choice of nylon 11 for the resin matrix function.

The processing of "filled" plastics has been the state of the art in injection molding for many years. When the plastic or polymer is highly filled with finely divided metals, it provides qualities not usually found in the plastic product. The expression "composite" is now generally used to describe the union of two or more diverse materials to attain synergistic or superior qualities to those exhibited by the individual members. In this particular case, the appellation "metal polymer composite" is representative of a unique combination of metals and polymers used to achieve improved quality of the product.

It relates to the technology of mixing finely divided metals in powder forms into plastics or polymers, such as thermoplastics and thermoset resins.

The particular frangible material of the present invention can be classified as a metal polymer composite due to its composition which includes:

a metal filler: ultra fine copper powder;

a binder: thermoplastic polymer resin; and a wetting agent or lubricant: calcium and zinc stearate, molybdenum disulphide, organo zirconate.

Once selected, these components are mixed, homogenized and made up in granules in accordance with the following steps:

a) raw materials are pre-weighed according to the determined final mix;

b) then, there is dry blending or tumbling of dry metal powders, polymer particles and additives;

c) a thermal blending or combination of solid particles is prepared with the use of equipment which will mix together different materials into a uniform single homogeneous mass;

d) a screw extruder is used to optimize the quality of the extruded composite mass. Temperatures are attained to melt the polymer, adhesively bonding it to the solid metallic particles. A conventional twin-screw extruder is preferably used to extrude the compound. The output passes through a dicing chopper, or pelletizer, which delivers the material in a form suitable for feeding the hoppers of injection molding machines;

e) the finely divided composite of metal and polymer which has been prepared by thermal extrusion blending is then classified in particle size according a specific pattern.

To achieve the injection molding of the projectiles, the frangible compound must have the following characteristics:

enough fluidity to be handled through the injection screw and barrel of the injection machine without creating any solidification before molding;

uniform particle distribution in the compound to generate a consistent projectile weight within the established tolerances and an uniform frangibility;

adequate homogeneity of the compound to obtain uniform mechanical properties after molding;

uniformity of density of the compound to minimize porosity and localized weakness points;

lowest shrink factor to respect the dimensional tolerance;

good granulometry dispersion to minimize separation of the compound during handling at the injection molding step;

low water absorption of the compound to allow dimensional stability during storage period of the molded parts;

good lubricity of the molded dart to facilitate demolding and minimum friction in the gun barrel during firing;

a minimum melt index value required to be sure of the moldability of the compound inside an extrusion and injection machine.

Nylon 11 and nylon 12 are preferred because they have the lowest moisture retention characteristics of the polymer family. The morphology of nylon 11 and nylon 12 can be described by two phases: an amorphous phase and a crystalline phase where the crystallinity is in the order of 20%.

In practice, the semi-crystallinity nature of nylon 11 is characterized by its heat of fusion (11 calories/gram), its melting point (185° C.), its high crystallization rate and its low water absorption to saturation which, at 20° C. and 65% relative humidity, is 0.9 to 1.1%;

at 20° C. and 100% (RH), is 1.6 to 1.9%; and at 100° C. and 100% (RH), is 2.4 to 3.0%.

One selected grade for the frangible application is the nylon 11 from ATOCHEM FRANCE: NAT ES having a size particle (0–80 μm).

In general, nylon 11 and nylon 12 are linear and semi-crystalline thermoplastics. Nylon 11 is derived from castor oil and nylon 12 comes from butadiene. Because of differences in crystal structure caused through amide group, nylon 12 has a slightly lower melting point and density. Nylon 11 performs better at higher temperature and, in addition, has superior UV resistance. Both materials are not so sensitive to changes in humidity as other polyamides. Nylon 11 has a higher heat distortion and a better low temperature impact resistance. Compared to nylon 6, nylon 66 and nylon 610 (disclosed in the above-noted PCT application), nylon 11 and nylon 12 have a low melting point, low density, low shrink and, by far, the lowest moisture regain.

Copper is selected for the following characteristics: specific gravity: 8.8–8.95; lead free; ductibility; good adherence to polymer; non abrasive; cost efficiency. The selected grade is directly related to the particle geometry which has been determined to be spheroidal to allow high loading in thermoplastic resin and permit extrusion and injection molding. Spheroidal is meant to designate copper particles which are not perfectly spherical. Satisfactory results have been obtained with particles having a form factor between 1 and 1.2 (which is the ratio of the longest diameter to the shortest diameter).

As examples, two different grades of copper have been used:

US bronze C118 which is classified as a spherical powder 99.2% copper with a nominal mesh of less than 200;

Alcan 155 which is a spherical powder 99.0% copper with the following particle size distribution:

10% of particles finer than 11 μm;

50% of particles finer than 22 μm; and

90% of particles finer than 44 μm.

A wetting agent or coupling agent may be used to facilitate a most uniform liaison between copper particles and improve the flexibility of the composite mix. An organo-zirconate from Kenrich Petrochemical (KRN2 44) has been used and shown good results.

Other additives may be used to act as lubricant such as stearate salts and molybdenum disulphide.

It is therefore wished that the present description should not be limited in interpretation except by the terms of the following claims.

The embodiments of the invention in which an exclusive property or privilege is claimed are defined as follows:

1. A frangible practice ammunition comprising a compacted mixture of fine copper powder and of a thermo plastic resin selected from the group consisting of nylon 11 and nylon 12; said copper powder being of at least 92% by weight; said mixture having a minimum specific gravity of 5.7.

2. A frangible practice ammunition as defined in claim 1, wherein said mixture is an injection molded compacted material.

3. A frangible practice ammunition as defined in claim 1, wherein said copper powder consists of particles having a spheroidal shape.

4. A frangible practice ammunition as defined in claim 3, wherein a major portion of said particles have a size finer than 44 μm.

5. A frangible practice ammunition as defined in claim 1, wherein said resin is a fine powder having a size of less than 80μ.

6. A frangible practice ammunition as defined in claim 1, wherein said fine copper powder is about 92.5–93.5% by weight.

7. A frangible practice ammunition as defined in claim 6, wherein said thermoplastic resin is about 6.5–7.5% by weight.

8. A frangible practice ammunition as defined in claim 1, further comprising a lubricant.

9. A frangible practice ammunition as defined in claim 1, further comprising a wetting agent.

10. A frangible practice ammunition as defined in claim 1, wherein said mixture has a weight of up to 36 grains for a 5.56 mm calibre.

11. A frangible practice ammunition as defined in claim 1, wherein said mixture has a weight of up to 85 grains for a 9 mm calibre.

* * * * *